US005092053A

United States Patent [19]

Roberts

[11] Patent Number: 5,092,053

[45] Date of Patent: Mar. 3, 1992

[54] BRACKET TYPE SCOPE SIGHT MOUNTING FOR ARCHERY BOWS

[75] Inventor: Kent S. Roberts, American Fork, Utah

[73] Assignee: Inventive Technology, American Fork, Utah

[21] Appl. No.: 718,361

[22] Filed: Jun. 20, 1991

[51] Int. Cl.[5] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,542,501 | 2/1951 | Fredrickson | 33/265 |
| 2,545,454 | 3/1951 | Fredrickson | 33/265 |
| 4,294,017 | 10/1981 | Byrnes et al. | 33/265 |

*Primary Examiner*—Harry N. Haroian
*Attorney, Agent, or Firm*—Mallinckrodt & Mallinckrodt

[57] ABSTRACT

A bracket plate type of scope sight mounting for archers, which may be constructed for mounting on a bow, either rearwardly of the bow toward the archer or forwardly of the bow away from the archer, has a rack and pinion mechanism for adjusting range of an arrow's flight, the rack of which mechanism is curved along its length and is affixed to an elongate bracket plate which is adapted to itself be affixed at one of its ends to a bow. The rack fits into an open, slideway groove formed in and extending transversely of the longitudinal extent of an elongate scope sight mounting block that is adapted to be slidably attached to the bracket plate, at one face thereof for up and down movement relative thereto, by structure including the pinion of the rack and pinion mechanism and desirably by a special washer assembly that provides resiliency. A scope sight mounting arrangement, which may be of dovetail type, extends slidably through the bracket plate and is adapted to carry a scope sight at the opposite face of the bracket plate for up and down movement with mounting block.

3 Claims, 2 Drawing Sheets

BRACKET TYPE SCOPE SIGHT MOUNTING FOR ARCHERY BOWS

FIELD

The invention is in the field of range adjustable, scope sight mountings for archery bows and particularly those of bracket mounting type.

STATE OF THE ART

Elongate scope sights as developed for and customarily used on firearms have long been recognized as being useful in the field of archery, and many diversified versions of special range-adjustable mountings for enabling such scope sights to be effectively attached to archery bows and effectively adjusted to proper range settings, for individual archers and for atmospheric conditions existing at any given time, have been proposed.

Thus, in my U.S. Pat. No. 4,961,265 issued Oct. 9, 1990 a bracket type of scope sight mounting is provided with step-by-step adjustable, predetermined range settings by means of an arcuately slotted, toothed wheel serving as a cam member for raising and lowering the scope sight to accommodate different ranges of arrow flight, and with a cooperating detent member for holding the cam member in any adjusted position as set by the archer.

Others had previously employed what in effect was a rack and pinion, rather than a toothed wheel and detent, to enable the selective setting of range by the archer. However, for one reason or another these have not met with commercial success. For example, the device shown in U.S. Pat. No. 4,294,017 granted to Byrnes et al. on Oct. 13, 1981 provides a rack and pinion construction only by mounting separate detent teeth blocks in and along a longitudinal groove provided by an elongate, curved support, a spring pressed detent lever being provided for manual release and resetting at the option of the archer.

SUMMARY OF THE INVENTION

In the making of the present invention, it was a principal objective to utilize a rack and pinion, selective range setting mechanism for achieving, simply and effectively, an unusually wide range of possible range settings while maintaining the scope sight at approximately a given up and down position with respect to eye level of the archer.

It was another objective to provide, in a simple way, for absorbing possible irregularities in bow surfaces along the length of the path of range adjustments.

These and other objectives were accomplished by utilizing the basic bracket orientation of my previously mentioned U.S. Pat. No. 4,961,265, so the scope sight can project either rearwardly or forwardly of the bow and with the bowstring substantially in line with the center of the scope as viewed through the scope and within the usual window of the bow.

As so oriented and in accordance with the novel construction of the bow sight mounting of this invention, the scope sight is adapted to rise and fall along its length and from end to end thereof in accordance with and during adjustment for the particular range setting selected by the user from time to time.

Slidably mounted by an elongate bracket plate having one end adopted to be secured to a bow, preferably in an adjustable up and down manner, is an elongate scope-mounting block. Fixedly attached to and extending upwardly and downwardly relative to the bracket plate is a rack appropriately curved along its length extending transversely of the lengths of both the bracket plate and the scope-mounting block. The block is grooved as a slideway to receive the rack and to permit both block and the scope sight carried thereby to move upwardly and downwardly relative to the bow as a pinion detent, journaled in and by the block, is rotated in the direction and to the extent required by the particular range setting selected by the archer from time to time. An external thumb knob permits the archer to do this manually.

THE DRAWINGS

The best mode presently contemplated for carrying out the invention in actual practice is illustrated in the accompanying drawings in which:

FIG. 1 represents a side elevational view of a scope sight mounting in accordance with the invention shown projecting rearwardly toward the archer from securement to a bow (indicated by broken lines), the view being taken from the right side of the archer holding the bow;

FIG. 2, a bottom plan view of the mounting of FIG. 1 as indicated by the line 2—2 in FIG. 1, but shown as from above when the mounting is turned over;

FIG. 3, an elevational view of the mounting of FIG. 1 taken from in front of the bow as indicated by the line 3—3 in FIG. 1;

FIG. 4, a view in vertical section taken along the line 4—4 in FIG. 1 and drawn to a larger scale;

FIG. 5, a side elevational view showing the opposite side of the mounting from that shown in FIG. 1, as indicated by the line 5—5 in FIG. 3, the bow not being indicated in this view and the range setting of the scope sight having been moved to accommodate a longer range;

FIG. 6, a view in horizontal section taken along the line 6—6 of FIG. 1 and drawn to a larger scale;

FIG. 7, a similar horizontal section taken along the line 7—7 of FIG. 1; and FIG. 8, a view corresponding to that of FIG. 1 but showing an embodiment of the invention constructed for and installed to project forwardly of the bow rather than rearwardly thereof as in FIG. 1.

DETAILED DESCRIPTION OF THE ILLUSTRATED EMBODIMENTS

As illustrated in FIGS. 1–7, the scope sight mounting of the invention may be constructed for attachment to a conventional archery bow 10, usually of compound type having a so-called window opening, **10*a***, provided approximately centrally of bow length for sighting purposes. However, the scope sight mounting of the invention may be adapted to use with any type of bow by structural modifications well within the skill of the art.

Figure 6:
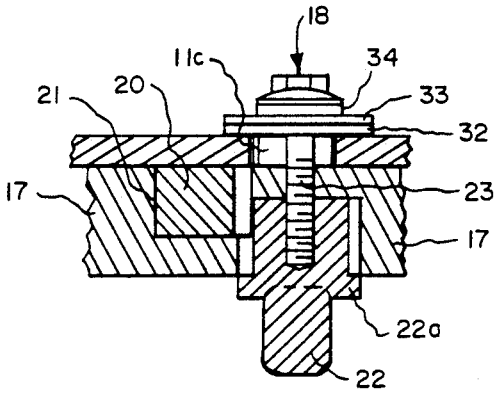
Figure 7:
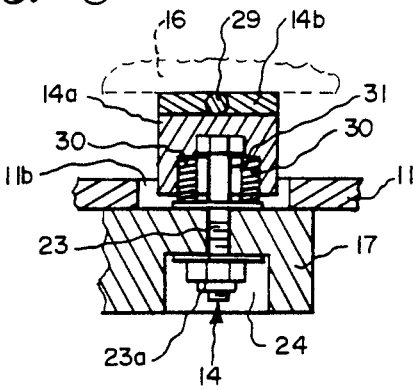
Figure 8:
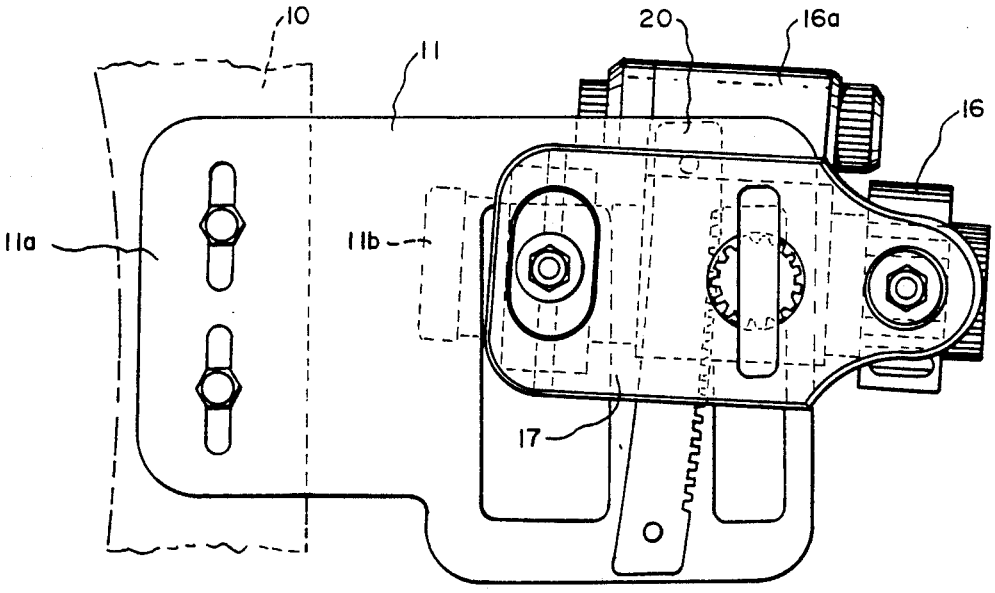

The mounting of the invention is of bracket type so it can be adapted for projecting rearwardly of the bow, that is to say toward the archer, as is the embodiment of FIGS. 1–7, or forwardly of the bow and away from the archer as is the embodiment of FIG. 8.

Figure 1:
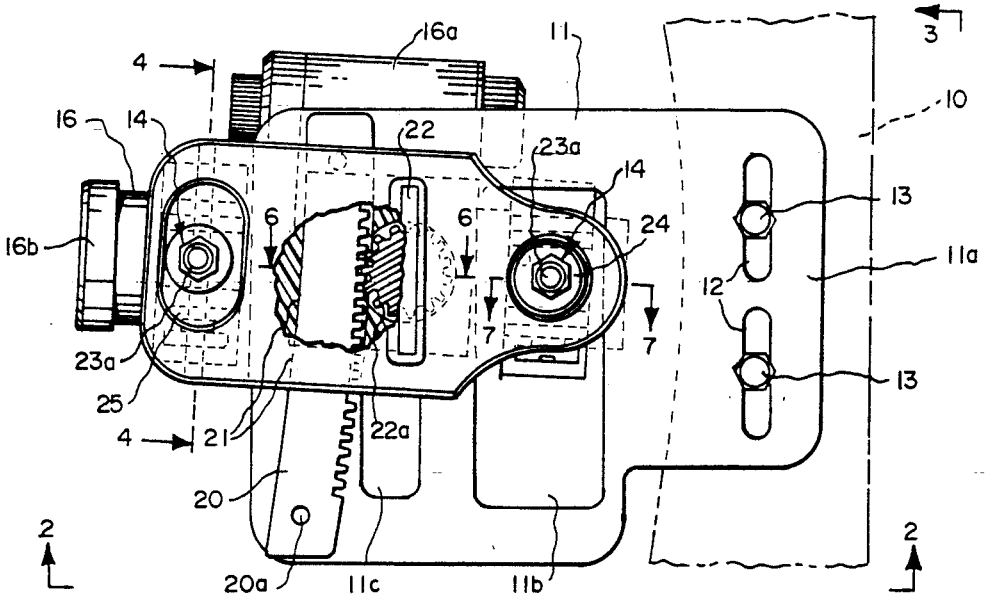
Figure 2:
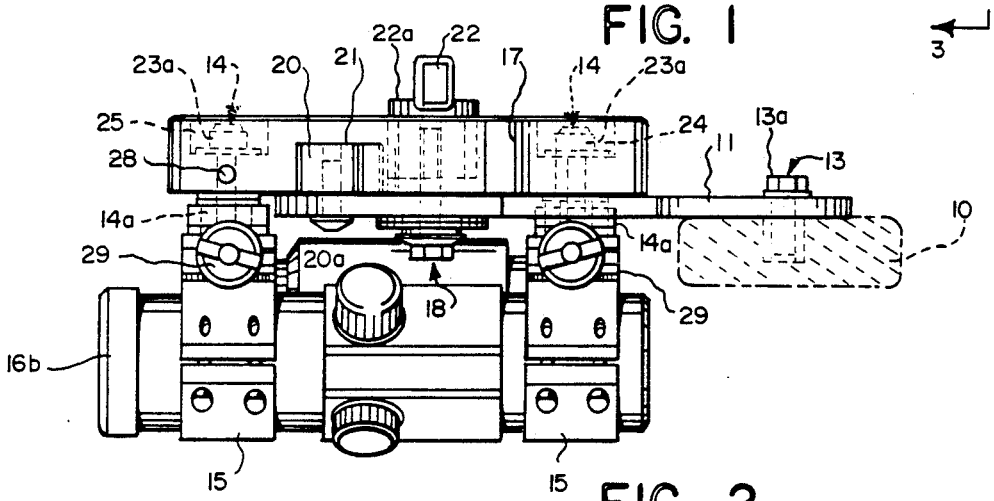

Continuing with the description of the embodiment of FIGS. 1–7, a horizontally elongate bracket plate 11 has a forward end **11*a*, here shown as provided with substantially vertical bow-mounting slots 12 (though optionally replaceable by a vertical series of closely spaced holes) through which screw threaded clamp fasteners 13, having hex tightening heads 13***a*, FIG. 2, extend for rigidly securing the scope sight mounting and its carried scope sight to the bow in a position suited to the individual archer. As so mounted on the bow, bracket plate 11 projects rearwardly of bow 10 toward the archer holding the bow.

Bracket plate 11 is slotted substantially vertically, as at 11*b*, adjacent to its bow-mounting end 11*a* for receiving and adjustably accommodating (for adjusting movement transversely of the bracket plate and at one face of such bracket plate) one of a pair of scope sight securing means 14, each of which is in the form of a dovetail member 14*a* of a usual two part ring clamp 15. Such one of the pair of securing means is adapted to receive and hold the forward end of a standard scope sight 16, which may be of red dot, cross-hair, or other suitable type, though shown here as of red dot type powered by size AA flashlight batteries in an elongate case 16*a*. As here shown, bracket plate 11 is preshortened longitudinally so as to accommodate adjusting movement of the other of the pair of scope securing means, i.e. a second dovetail member 14*a* of a second ring clamp 15 remote from mounting end 11*a* of the mounting plate.

A horizontally elongate mounting block 17 is adapted to be fastened to bracket plate 11 at the opposite face thereof by a screw-threaded clamping assembly 18, FIG. 6, conveniently located approximately midway of the length of mounting block 17 and slidably accommodated for up and down adjusting movement of scope sight 16 transversely of the length of bracket plate 11 by a substantially vertical slot 11*c* in such bracket plate.

Figure 3:
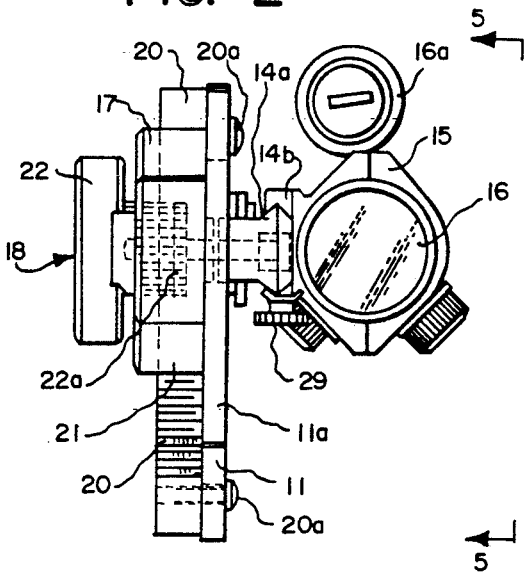
Figure 5:
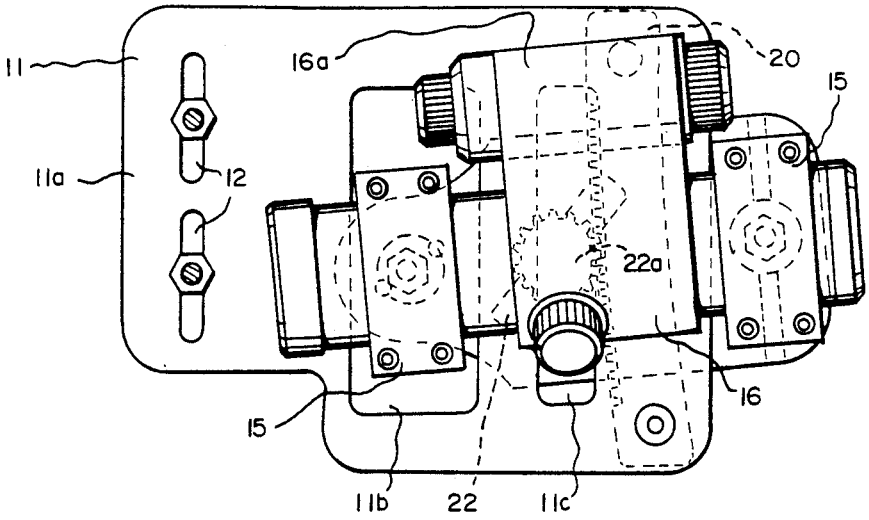

For effecting up or down movement of scope sight 16 relative to its mounting on bow 10 in adjusting for a particular range of arrow flight selected by the archer, an elongate rack 20, FIG. 3, is affixed as by means of screws 20*a* substantially vertically to the face of bracket plate 11 that confronts mounting block 17 and is accommodated by an open substantially complimentaly curved groove 21 in such mounting block.

Clamping assembly 18 includes a toothed pinion wheel member 22*a*, FIGS. 1 and 3, as an integral part of a thumb knob 22, such pinion wheel member being in mesh with rack 20. As shown, rack 20 is of arcuate configuration, with the rack teeth formed along the convex face of the arc, so travel of pinion wheel 22*a* and mounting block 17 will impart differential travel to opposite ends, respectively, of scope sight 16, thereby maintaining the eyepiece end of such scope sight at approximately a constant eye level while moving the other end appropriately for a selected range of arrow travel. An unusually wide extent of possible range settings is available for the archer with the scope sight mounting of the invention. Thus, a length of four inches for rack 20 with eight teeth per inch will provide precise range settings from zero yards up to about 130 yards, depending upon the strength of the bow. The stronger the bow, the larger the range of settings. The radius of curvature of the arcuate rack may vary to accommodate different bow strengths. The stronger the bow, the flatter the trajectory of an arrow shot from the bow over a given distance and generally the greater the radius desired for the rack. The greater the radius, the less relative movement of one end of the scope compared to the other as the scope itself moves up or down. A radius of about twenty inches has been found satisfactory for most bows if the scope bracket is mounted between the archer and the bow, while a twenty-five inch radius has been found satisfactory for most bows if the scope bracket is mounted in forward position.

Scope sight 16 is fixedly fastened adjacent its opposite ends to the opposite ends, respectively, of mounting block 17 by the pair of scope sight securing means 14, i.e. by the respective dovetail assemblies, each of which has a bolt member 23 connecting with mounting block 17. The nut ends 23*a* of bolt members 23 are preferably inset in respective recesses 24 and 25 so as to be out of the way.

Figure 4:
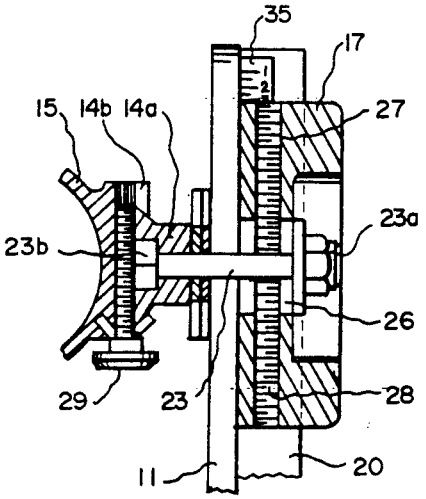

For close yardage adjustment purposes, an upwardly and downwardly elongate slot 26, FIG. 4, is provided at the rearward end of mounting block 17 for the corresponding bolt member 23 of the scope sight securing means. Upward and downward positional adjustment of such bolt member 23 and of the rearward, eye piece end 16*b* of scope sight 16 is effected by set screws 27 and 28. At the forward end of mounting block 17, transverse positional adjustment of scope sight 16 to compensate for windage is effected by turning nut 23*a* in recess 24 either clockwise or counterclockwise as may be required.

It should be noted from FIG. 4 that the head ends 23*b* of bolt members 23 are received by corresponding recesses, respectively, in dovetail pieces 14*a*, and that such dovetail pieces are fastened to respective receiving dovetail pieces 14*b* of ring clamps 15 by respective screws 29.

The scope sight securing means 14 at the forward end of mounting block 17 corresponds to that at the rearward end thereof, except for the close yardage adjustable feature, and, as shown in FIG. 7, has the dovetail piece 14*a* resiliently mounted by small coil springs 30 positioned at opposite ends, respectively, of a longitudinal recess 31 in such dovetail piece similarly to the showing in FIG. 9 of my aforesaid U.S. Pat. No. 4,961,265. This allows windage adjustment of the scope.

As in my patent, antifriction washers are positioned between each element that slides, and the surface against which it slides. Here a special antifriction and resilient washer assembly is provided in the clamping assembly 18 of FIG. 6, and includes an antifriction washer 32, such as of Nylon, a steel washer 33, and a springy washer 34, such as of Neoprene plastic, to absorb the effect of possible bow surface irregularities and for holding the scope sight securely during shooting of arrows, yet permitting range adjustments to accommodate different yardages selected by the archer for arrow flight.

The scope sight mount is installed for use by first attaching bracket plate 11 to the bow within and midway of the length of the bow windows 10*a* by means of clamp fasteners 13 placed in the centers of slots 12, or similarly if a series of independent holes are provided instead of slots. The scope sight, 16, is then attached to the mount by the dovetail securing means 18 in customary manner, with the bowstring 10*b* substantially in line with the red dot, as indicated in FIG. 4. The bow is then sighted, using target ranges of known distances and starting at the closest yardage that the archer anticipates he will use. The bow should then be drawn to the archer's normal anchor position, with the arrow pointed at the target. After looking down the arrow at the target, the archer should sight through the scope sight, 16, to determine whether the arrow would hit the target to the right or left and high or low. It might be necessary to adjust close yardage set screws 27 and 28 for height and windage nut 23*a* at the forward end of mounting block 17 to move the scope sight either to the left or the right of the archer in order to see the red dot in the scope.

For preliminary sighting, if the arrow hits low on the target, correction is effected by moving the rear dovetail mount up; vice verse if the arrow hits high on the target.

To establish correct settings for various yardages, thumb knob 22 is turned progressively and the respective yardages are marked on a strip 35, FIG. 4, adhesively attached to the rear face of rack 20.

As previously indicated, the scope sight mount of the invention can be constructed for mounting either toward the rear of the bow, as is the foregoing embodiment, or forwardly of the bow, as in FIG. 8 where like parts are identified by the same reference numbers, the only difference being in the placement of the bow-mounting end of the bracket plate relative to the scope sight mounting block. Thus, in the embodiment of FIG. 8, the orientation of the mounting block 17 relative to the bracket plate 11 is the reverse of that of the embodiment of FIGS. 1 to 7. Instead of the bow mounting end 11*a* of scope sight mounting plate 11 being adjacent to the windage adjustment end of mounting block 17, it is remote therefrom, as shown in FIG. 8.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A bracket plate scope sight mounting for archery bows that provides for selective range settings over an unusually wide range while maintaining position of the scope sight substantially at a predetermined eye level, comprising an approximately horizontally elongate bracket plate adapted for attachment, at one end thereof, to an archery bow and for slidably mounting at and transversely of one longitudinal face thereof an elongate scope sight mounting block; respective means at opposite ends of said mounting block for securing a scope sight longitudinally of said bracket plate and of said mounting block at the opposite face of said bracket plate, said bracket plate being slotted transversely of its longitudinal extent to accommodate transverse movement of the corresponding scope sight securing means, the other of said scope sight securing means being located so as to be similarly transversely movable relative to said bracket plate; up and down slidable means for fastening said mounting block to said bracket plate, which plate is slotted for receiving and guiding said slidable means; an elongate rack secured to and projecting from and transversely of said one face of said bracket plate, said mounting block having a rack-receiving groove at and extending transversely of its longitudinal extent at the face thereof that confronts said bracket plate; a detent pinion wheel in said mounting block adjacent to said rack and in mesh therewith; and means manipulatable by the archer for setting range by rotating said detent pinion wheel to a selected mesh position with said rack, thereby moving said rack upwardly or downwardly relative to the bow to which said scope sight mounting is attached, as determined by the archer.

2. A bracket plate scope sight mounting according to claim 1, wherein the means at opposite ends of the mounting block for securing a scope sight are each provided with means for shifting said scope sight to the right or to the left of the archer as may be required to adjust for wind conditions.

3. A bracket plate scope sight mounting according to claim 2, wherein the means at opposite ends of the mounting block for securing a scope sight are dovetail mounting assemblies, each fastened to the mounting block and to the scope sight by bolt means provided with an adjustment nut, said nut being the means for shifting said scope sight to the right or to the left.

* * * * *